United States Patent [19]

Zide

[11] Patent Number: 4,651,356

[45] Date of Patent: Mar. 24, 1987

[54] HELMET CHIN STRAP

[75] Inventor: Robert M. Zide, Williamstown, W. Va.

[73] Assignee: Pro-Line, Inc., Marietta, Ohio

[21] Appl. No.: 839,025

[22] Filed: Mar. 12, 1986

[51] Int. Cl.[4] ..... A42B 3/00

[52] U.S. Cl. ..... 2/421; 2/425

[58] Field of Search ..... 2/421, 9, 424, 425, 2/5, 6, 7, 10, 410, 411, 412, 414

[56] References Cited

U.S. PATENT DOCUMENTS

| | | | |
|---|---|---|---|
| 3,327,316 | 6/1967 | Pukish, Jr. | 2/421 |
| 3,787,895 | 1/1974 | Belvedere | 2/9 |
| 3,916,446 | 11/1975 | Gooding | 2/421 |
| 4,062,068 | 12/1977 | Davenport et al. | 2/421 |

*Primary Examiner*—Peter Nerbun

[57] ABSTRACT

A unitized chin strap for football helmets and the like is molded from an elastomer possessing elastic memory. The device includes a protective chin cup which is curved on two axes and is adapted to receive an apertured chin cushioning pad which allows the tip of the chin to be safely suspended in a space defined by the chin strap cup. The cup gradually diminishes in thickness and rigidity from the center of the cup toward its marginal edge. Divergent axis relatively flexible and somewhat stretchable straps are joined to the sides of the chin cup by relatively wide twist-resistant strap-to-cup joint portions. Conventional buckles having snap fastener components are slidably engaged on the straps of the device to provide a secure four point attachment of the chin strap to a helmet. The device substantially eliminates movement of the helmet on the head during use, thereby greatly reducing the likelihood of severe injury.

6 Claims, 8 Drawing Figures

HELMET CHIN STRAP

BACKGROUND OF THE INVENTION

A number of types of chin straps for athletic helmets including football helmets are known in the prior art. One type includes a soft flexible chin cup having attaching straps stitched to its opposite sides and being adapted for connection with fastener means on the opposite sides of the helmet. This device includes a cloth lining for the flexible chin cup. The device offers little protection to the chin and tends to irritate the chin, sometimes producing skin infection due to abrasion in the presence of perspiration and accumulated dirt. Moreover, the stitching connecting the attaching straps to the chin cup tend to fail. The overall flexibility of the prior art structure largely defeats the main purpose of the present invention which is the elimination of movement of the helmet on the head while the chin strap is in place.

Other known prior art chin straps involve the use of cup elements which are separate from a strap assembly and are held removably in a slit separated central portion of the strap. The arrangement is not secure and does not adequately protect the chin and prevent pivoting or other movement of the helmet on the head. This latter prior art chin strap arrangement is shown in U.S. Pat. No. 3,619,813.

Prior U.S. Pat. Nos. 3,166,761; 3,916,446 and 4,051,556 show further helmet chin strap structures which suffer from the defects noted above or other defects, such as unduly complex and costly construction, insecure or weak attachment means, or the use of materials which make it difficult or impossible to maintain the device in a clean sanitary condition by washing.

In contrast to the prior art, the present invention provides a helmet chin strap unit formed of a synthetic elastomer possessing an elastic memory. The improved chin strap very adequately achieves the primary objective of the invention in securing the helmet against movement on the head, while simultaneously providing very good protection to the chin. The elasticity of the strap extensions of the device cause the helmet to return automatically to its correct position on the head following heavy blows which will cause some momentary shifting of the helmet. The elastic memory of the material of which the device is made assures the returning of the displaced helmet to its normal protective position on the head.

Moreover, the material employed is susceptible to very easy washing and a unique apertured chin cushioning pad within the cup of the chin strap secures the tip of the chin safely within a space defined by the interior of the cup. The cup, which is quite rigid at its center, protects the chin from direct blows. The chin cushioning pad or insert is also formed of materials which are readily washable and which do not tend to irritate and abrade the skin.

In accordance with the present invention, the geometry of the chin strap device is carefully conceived to provide a four point anchorage to the helmet through two pairs of divergent axis straps which are integrally joined to the opposite sides of the chin cup by wide twist-resistant and relatively stiff joint portions. The attaching strap extensions themselves are relatively flexible but are very strong. The device is completely without stitching or other connecting means subject to failure.

Another important feature of the invention is that the chin cup is contoured on two axes to properly fit the chin and diminishes gradually in thickness from the center of the cup which is quite rigid toward its marginal edges which are comparatively less rigid, although stiff in comparison to the strap extensions. The wide joints between the strap extensions and the chin cup derive rigidity and resistance to twisting from their widths and thicknesses along with a rigidifying effect caused by the channel formation of the chin cup where it blends into the wide joints between it and the strap extensions.

One of the most important aspects of the invention derived from its construction as discussed above is the substantial elimination of the so-called "rebound effect" caused by movement of the helmet on the head in response to a blow. The heavier the blow the greater the rebound effect produced under the prior art. With the present invention, this problem to a great extent is eliminated by the ability of the chin strap to hold the helmet securely on the head with some of the impact forces being transmitted to the chin and jaw through the improved chin strap.

Other objects and advantages of the invention will become apparent to those skilled in the art during the course of the following description.

DETAILED DESCRIPTION

Figure 1:
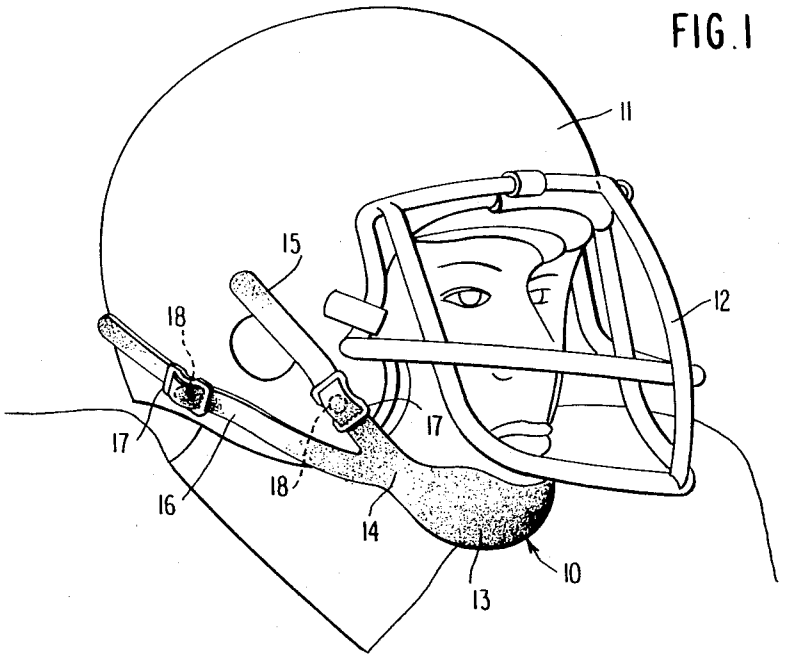
FIG. 1 is a perspective view of a helmet chin strap according to the present invention.

Referring to the drawings in detail, wherein like numerals designate like parts, an improved chin strap 10 according to the present invention is shown in its use position on a football helmet 11, FIG. 1, having a face guard 12.

Figure 2:
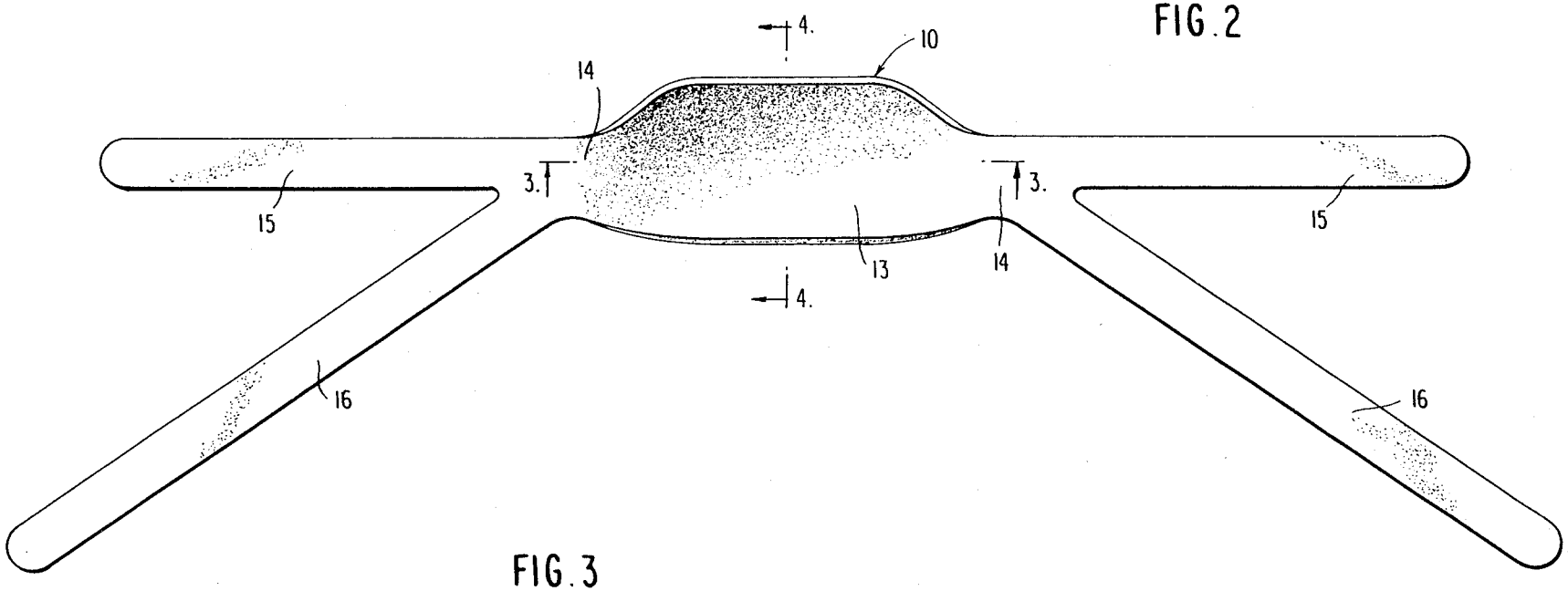
FIG. 2 is a plan view of the chin strap in a non-use relaxed state.

The chin strap 10 is shown in FIG. 2 in a relaxed nonuse position. It is a unitary device molded from an elastomer such as polyethylene or polyurethane. The material employed for the chin strap possesses a significant elastic memory for reasons to be described.

Figure 3A:
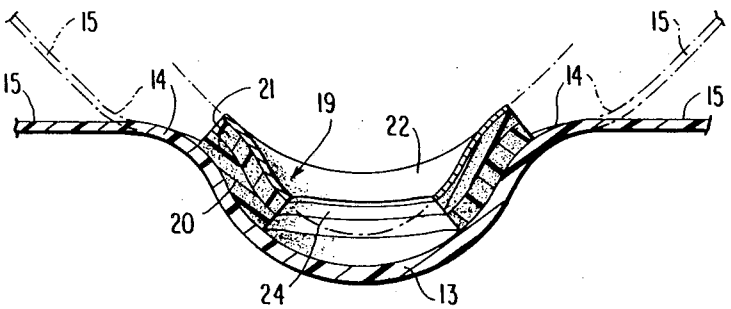
FIG. 3A is a sectional view similar to FIG. 3 showing the assembled relationship of the chin cushioning pad and chin cup.
Figure 3:
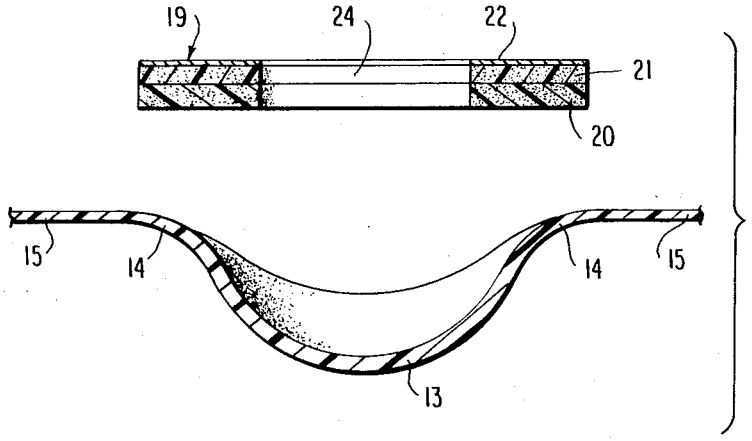
FIG. 3 is an enlarged fragmentary exploded vertical section taken on line 3—3 of FIG. 2 showing the chin strap cup and a chin cushioning pad which has been omitted in FIG. 2.

The chin strap 10 comprises a center somewhat elongated chin cup 13 which is contoured to fit the chin on two orthogonal axes. The chin cup is quite stiff or rigid particularly at its center to provide maximum protection to the chin, and diminishes gradually in thickness and in rigidity toward its marginal edges which are of reduced thickness as shown in the drawings. At its opposite sides, the chin cup 13 is integrally joined with two relatively wide quite stiff twist-resistant connecting or joint portions 14 which derive strength and stiffness from their substantial widths, plus the fact that the two sides of the chin cup 13 are somewhat channel-shaped where they blend into the connecting portions 14. The two portions 14 are disposed in a plane across the open inner side of the contoured chin cup 13, as shown in FIGS. 3 and 3A. The wide connecting portions 14, FIG. 2, are approximately one-half the width of the chin cup 13 along its minor axis.

Pairs of divergent axis comparatively narrow strap extensions 15 and 16 are integrally connected with the wide portions 14. The shorter strap extensions 15 lie on the major longitudinal axis of the chin cup, FIG. 2, and the longer strap extensions 16 diverge downwardly from the extensions 15, relative to the chin, at angles of approximately 35°. The strap extensions 15 and 16 are considerably narrower than the connecting portions 14 and are more flexible due to being elongated. The strap extensions are readily bendable out of the plane in which they normally lie, FIG. 2, to facilitate attaching the chin strap to opposite sides of the helmet 11. However, the strap extensions resist bending within the plane in which they normally lie, FIG. 2.

The strap extensions 15 and 16 are equipped with readily adjustable conventional slide buckles 17 each carrying a snap fastener component 18 to mate with another component on the helmet 11. Other types of strap fasteners may be employed in some instances.

It should be emphasized that, in contrast to most of the prior art, the chin cup 13 in its entirety is rigid enough to hold its shape substantially under all conditions of use. This is true in spite of the fact that the wall thickness of the cup does diminish toward its margin and toward the wide connecting portions 14, as stated.

Figure 4:
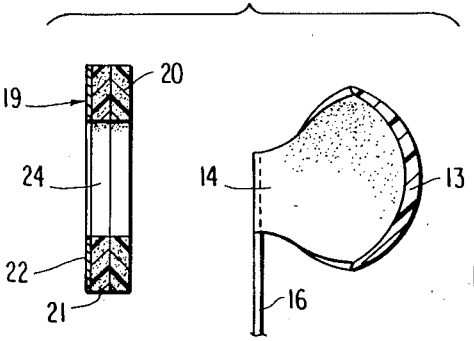
FIG. 4 is a fragmentary exploded vertical section similar to FIG. 3 taken on line 4—4 of FIG. 2.

A further feature of the invention is the provision in the chin cup 13 of a separately formed chin cushioning pad or insert 19. In one preferred embodiment, FIGS. 3 to 4A, the cushioning pad comprises an outer medium density layer 20 formed of polyethylene or polyurethane foam, carrying a pressure-sensitive adhesive layer or coating on its exposed face, an intermediate layer 21 of less dense polyethylene or polyurethane foam, and a thin interior fabric or textured plastics material sheet 22 for direct comfort-promoting contact with the chin of the wearer of the helmet. As shown in the drawings, the laminated composite cushioning pad 19 is flat when in a relaxed state and is elongated with arcuate ends 23, FIG. 5. The composite pad has a substantially rectangular elongated aperture 24 formed entirely therethrough. The composite pad thus constructed is sufficiently compliant to be placed in the relatively rigid chin cup 13 so that the cushioning pad assumes the contour of the interior surface of the cup and will adhere to this surface adhesively, FIGS. 3A and 4A.

The inner sheet 22 does not tend to irritate the skin and the cushioning pad is readily washable with the entire chin strap assembly. As shown in phantom lines in FIGS. 3A and 4A, when the chin strap is in place on the helmet, the tip of the chin is held securely in the space or chamber defined by the aperture 24 of the cushioning pad and in spaced relationship to the most rigid center portion of the chin cup 13. This affords maximum protection to the chin while the chin strap is serving its main purpose of holding the helmet 11 securely on the head without significant movement of the helmet.

When the strap extensions 15 and 16 are attached to opposite sides of the helmet by the buckle fastener means, the two wide connecting portions 14 are in substantially common planes with the strap extensions and the adjacent ends of the chin cup. Because of their widths and stiffness, the portions 14 strongly resist twisting or stretching, although the strap extensions 15 and 16 can yield and stretch somewhat under impacts delivered to the head, but will return to their normal states through the elastic memory effect of the material from which the chin strap is made.

It should also be noted that ventilating openings, not shown in the drawings, can be provided in the chin cup 13. This is an optional feature of the invention.

Figure 6:
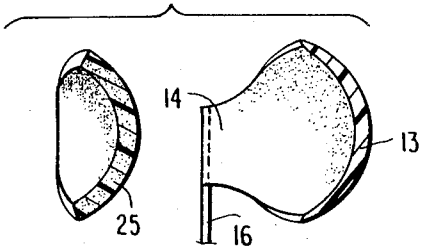
FIG. 6 is an exploded sectional view of the chin cup and a molded chin cushioning pad in accordance with a modification of the invention.

FIG. 6 of the drawings depicts a modification of the invention in which a unitary molded preshaped chin cushioning pad 25 formed of foam polyethylene or polyurethane is used in lieu of the laminated cushioning pad 19. The molded cushioning pad 25 does not possess the aperture 24, as illustrated, but can, if desired, be provided with ventilating apertures to register with ventilating apertures in the chin cup 13. The molded cushioning pad 25, like the pad 19, is adhesively held in the chin cup 13.

The improved chin strap device provides a stable and geometrically efficient four point connection of the chin strap to the helmet with reaction forces being transmitted from the chin through the chin strap to hold the helmet 11 snugly on the head without significant pivoting or swiveling of the helmet. Dangerous rebound effect caused by blows to the head is minimized. The elastic memory capability of the chin strap allows some yielding at the moment of impact, followed by quick return of the helmet to its proper position on the head. The chin and lower jaw are effectively protected by the substantially rigid chin cup. The entire structure is washable to minimize bacteria and moisture build-up. The wide connecting portions 14 between the chin cup and strap extensions 15 and 16 resist twisting, stretching and buckling because they are short, as well as wide, and because they derive rigidity from the channel-like ends of the chin cup 13 with which they are integrally connected. The portions 14 have widths at least 1½ times the width of each strap extension 15 or 16.

Figure 4A:
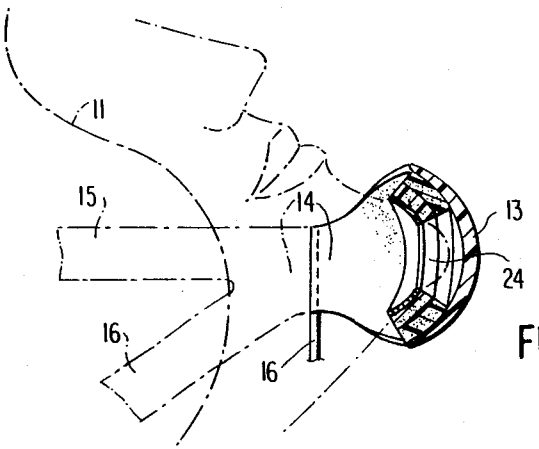
FIG. 4A is a sectional view similar to FIG. 3A depicting the assembled relationship of the chin cushioning pad and chin cup.
Figure 5:
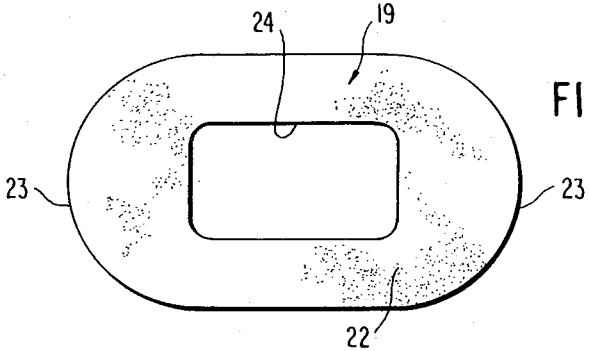
FIG. 5 is a plan view of the chin cushioning pad in its relaxed flat state.

When the strap extensions 15 and 16 are connected to a helmet, as indicated in phantom lines in FIGS. 3A and 4A, they together with a portion of each wide connection portion 14 are bent out of the plane in which they normally lie which is parallel with the major longitudinal axis of the chin cup 13, into planes which lie at acute angles to the major longitudinal axis of the chin cup 13. In this position since the widths of the connecting portions 14 are approximately half the width of the chin cup 13, and are molded from a material that resists bending in the plane in which they lie, the planes of the wide connecting portions being at acute angles to the chin cup form the sides of a substantially rigid channel with the chin cup forming the bottom of the channel. This configuration prevents the chin cup 13 from rotating about its major longitudinal axis relative to the planes of the connecting portions 14 and the strap extensions 15 and 16, and relative to the helmet.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A helmet chin strap of unitary construction formed by molding of an elastomer comprising a chin cup which is stiff and contoured to fit the chin on two axes and being elongated in a direction across the width of the chin, the chin cup having a wall thickness which gradually diminishes from a maximum thickness region near the center of the cup toward the margin of the cup so that the marginal region of the cup is less rigid than its center portion, wide connecting portions integrally joined with the ends of the chin cup and being short in length along the longitudinal axis of the cup and being inherently stiff and twist-resistant, comparatively narrow relatively flexible elongated strap extensions integrally joined to said connecting portions and being arranged in diverging pairs, said strap extensions being adapted to carry thereon adjustable fasteners which coact with mating fasteners on opposite sides of a helmet, chin cushion means within said chin cup adapted to firmly engage the chin when the chin strap is in a use condition on a helmet, said chin cushion means comprising an apertured compressible chin cushion held within the chin cup and conforming to the contour of the interior of the cup and defining therewith a space within the cup where the chin of a user of the chin strap is suspended in spaced protected relationship to the interior surface of the chin cup, and said chin cushion including an exterior layer of comparatively dense cellular cushioning material, an intermediate layer of less dense and more yielding cellular cushioning material, and an inner comparatively thin sheet of material having properties promoting comfortable and safe engagement of the chin cushion with the skin of the chin of a user of the chin strap.

2. A helmet chin strap formed in one piece from a synthetic elastomer comprising a substantially rigid chin cup having a major axis and a minor axis and being curved along both axes, a pair of wide stiff twist-resistant connecting portions joined to the ends of the chin cup and being comparatively short along its major axis, the widths of said connecting portions being approximately one-half the width of the chin cup on its minor axis, a first pair of elongated strap extensions joined to said wide connecting portions so as to extend substantially on the major axis of the chin cup, and a second pair of elongated strap extensions joined to said wide connecting portions and being in divergent relationship to the first pair of strap extensions at an acute angle downwardly relative to the head of the wearer of a helmet equipped with the chin strap, said first and second pairs of strap extensions being adapted to carry adjustable fasteners to coact with mating fasteners on the opposite sides of the helmet.

3. A helmet chin strap as defined in claim 2, and said acute angle being substantially 35°.

4. A helmet chin strap as defined in claim 2, and a chin cushion means fixed within the chin cup.

5. A helmet chin strap as defined in claim 4, and the chin cup gradually diminishing in thickness along its major and minor axes from its center toward its margin.

6. A helmet chin strap as defined in claim 2, and said first pair of elongated strap extensions being substantially shorter than the second pair of elongated strap extensions, all of the strap extensions having a uniform width and thickness, and the width of each strap extension being approximately one-half the width of each wide connecting portion.

* * * * *